US010847283B2

(12) United States Patent
Bright

(10) Patent No.: US 10,847,283 B2
(45) Date of Patent: Nov. 24, 2020

(54) TOP DRIVE SERVICE LOOP CABLE ASSEMBLY WITH HEATING ELEMENTS

(71) Applicant: NEXANS, Courbevoie (FR)

(72) Inventor: Rudy Bright, Houston, TX (US)

(73) Assignee: NEXANS, Courbevoie (FR)

( * ) Notice: Subject to any disclaimer, the term of this patent is extended or adjusted under 35 U.S.C. 154(b) by 396 days.

(21) Appl. No.: 15/850,693

(22) Filed: Dec. 21, 2017

(65) Prior Publication Data

US 2019/0198196 A1 Jun. 27, 2019

(51) Int. Cl.

| | |
|---|---|
| ***H01B 7/29*** | (2006.01) |
| ***H05B 3/56*** | (2006.01) |
| ***H01B 7/04*** | (2006.01) |
| *H01B 7/18* | (2006.01) |

(52) U.S. Cl.

CPC ..... *H01B 7/29* (2013.01); *H01B 7/04* (2013.01); *H05B 3/56* (2013.01); *H01B 7/046* (2013.01); *H01B 7/183* (2013.01)

(58) Field of Classification Search

CPC .... H01B 7/29; H01B 7/04; H01B 7/041–046; H05B 3/56

See application file for complete search history.

(56) References Cited

U.S. PATENT DOCUMENTS

| | | | | | |
|---|---|---|---|---|---|
| 3,013,108 | A * | 12/1961 | Sweeney | H01B 9/06 | 174/99 R |
| 5,974,226 | A * | 10/1999 | Shaffer | E21B 17/206 | 166/302 |
| 2012/0006444 | A1* | 1/2012 | Tupper | E21B 17/20 | 138/149 |
| 2012/0082422 | A1* | 4/2012 | Sarchi | G01K 11/32 | 385/101 |
| 2012/0241040 | A1* | 9/2012 | Fogg | H01B 7/046 | 138/172 |
| 2013/0118746 | A1* | 5/2013 | Delp | E21B 36/006 | 166/302 |
| 2014/0318858 | A1* | 10/2014 | Pourladian | H01B 13/0006 | 174/70 R |
| 2017/0229215 | A1* | 8/2017 | Studer | H01B 9/003 | |
| 2017/0361789 | A1* | 12/2017 | Ohgushi | H01B 7/04 | |
| 2018/0226174 | A1* | 8/2018 | Rose | H01B 13/0006 | |
| 2018/0247733 | A1* | 8/2018 | Mann | H01B 11/12 | |
| 2019/0254122 | A1* | 8/2019 | Lee | H01B 7/295 | |

* cited by examiner

*Primary Examiner* — J C Jacyna

(74) *Attorney, Agent, or Firm* — Sofer & Haroun, LLP

(57) ABSTRACT

A cable including at least one primary conductor and at least one secondary conductor. A metallic shield element surrounds the primary and secondary conductors. A jacket surrounds the elements of the cable. At least one heating element is disposed under the shield element.

7 Claims, 1 Drawing Sheet

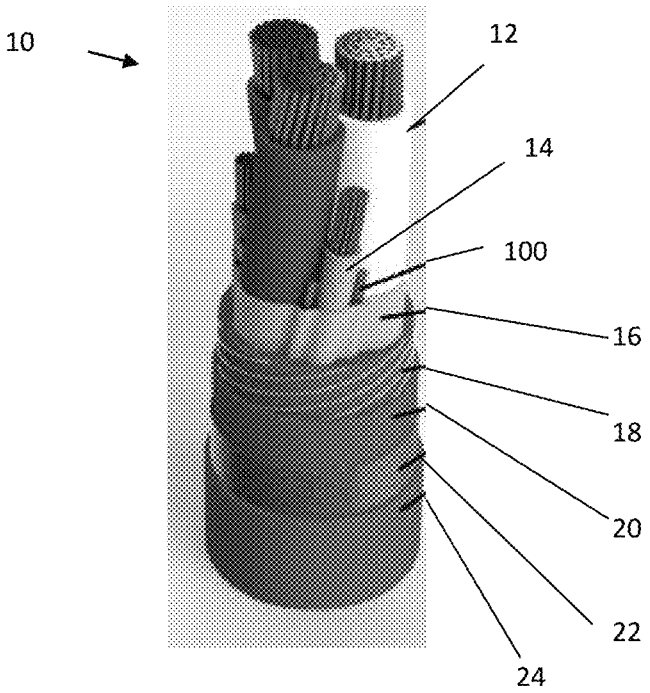
10
12
14
100
16
18
20
22
24

TOP DRIVE SERVICE LOOP CABLE ASSEMBLY WITH HEATING ELEMENTS

BACKGROUND

Field of the Invention

This invention relates to cables. More particularly, this invention relates to heavy industry power cables requiring pre-heating in cold environments.

Description of Related Art

Top drive service loop cables are an exemplary type of heavy industry cables that frequently operate in low temperatures or cold outdoor environments. Owing to the heavy industry requirements for safety and durability combined with cost limitations, the available range of polymers used for the insulation is limited. Owing to this, the typical polymers used for top drive service loop cables are very durable, but in the cold however, these polymers and other components of the cables are stiff when not in use. For example when the equipment is initially started in the cold, the insulation of the components of the top drive service loop cables can crack or break causing the cable to fail.

Some prior art solutions focused on using cold temperature compliant polymers that remain flexible at cold temperatures, but they are less chemical and abrasion resistant which is a typical requirement of top drive service loop cables/outdoor heavy industry cables. Polymers that do remain flexible at cold temperatures while also being sufficiently chemical and abrasion resistant can be cost prohibitive.

Alternatively, some operators preload the cable with power prior to moving or operating the connected machinery. Pre-loading refers to sending power through the conductors prior to use, where the pre-loaded voltage in the conductors provides inherent warming of the conductor and its insulation. This pre-loading is able to sufficiently soften cold exposed cables to prevent the polymer insulations from cracking. However, this procedure takes time and can also lead to problems if the operator forgets to initiate the pre-loading process.

BRIEF DESCRIPTION OF DRAWINGS

The present invention can be best understood through the following description and accompanying drawings, wherein:

The sole FIGURE illustrates a typical top drive service loop cable employing heating elements according to one embodiment.

DETAILED DESCRIPTION

The present arrangement as shown in the sole FIGURE, a top drive service loop cable 10 is provided with embedded heating elements 100.

The basic arrangement of top drive service loop cable 10 includes primary conductors 12, secondary conductors 14, an optional VFD (Variable Frequency Drive) shield 16, aramid fiber reinforcement 18, inner insulated jacket 20, braided armor 22 and outer jacket 24. This basic construction shown in the sole FIGURES is considered exemplary. Other constructions for heated top drive service loop cables are within the contemplation of the present invention. However, for illustration purposes the example shown in the sole FIGURE will be used to illustrate the salient features.

Primary conductors 12 are typically current carrying power conductors, used for example to power the top drive motors. Secondary conductors 14 are typically used for equipment grounding or can be used for control circuits. In the example shown in the sol FIGURE, there are three primary conductors 12 and three secondary conductors 14. Optional VFD (Variable Frequency Drive) shield 16 is typically made from a copper braid or tape (sometimes a metal laminate) and is used to contain electromagnetic interference. Aramid fiber reinforcement 18 is typically used to add longitudinal strength to the cable jacket as well as to provide radial cut-through resistance.

Inner insulated jacket 20 is typically made from a thermoset rubber polymer such as CPE (Chlorinated Polyethylene). This inner insulated jacket provides protection for the inner components of cable 10 and also provides a cushion for shield 16 to prevent it from damaging the insulation of conductors 12 and 14.

Braided armor 22 is typically composed of stainless steel wires and is used to provide longitudinal strength and radial cut through resistance. Finally, outer jacket 24 is typically made from a thermoset rubber polymer, and is designed to protect braided armor 22.

In one embodiment, heating elements 100 are powered heating cables, for example as available from Thermon under such trade names as HPT™, HTSX™, VSX™, and FP™, Heating elements are independent powered electric heating elements made from a heating/electric conductor within an insulation and may include other components for strength, safety etc. . . . . Preferably, heating element 100 includes a braided or composite conductor/heating element to assist with maintaining flexibility under the ordinarily harsh environmental and use conditions of top drive service loops. The sizing and wattage of such heating elements 100 can be adjusted accordingly based on the size of cable 10, the size of the components and the composition of the polymer/insulations that require the pre-heating.

As shown in the sole FIGURE, heating elements 100 are disposed in the interstices between primary conductors 12 and the secondary conductors 14 and directly below and abutting the VFD (Variable Frequency Drive) shield 16. Contact with the metallic VFD shield 16 helps evenly and quickly distribute heat from the heating elements into the other components of cable 10.

While only certain features of the invention have been illustrated and described herein, many modifications, substitutions, changes or equivalents will now occur to those skilled in the art. It is therefore, to be understood that this application is intended to cover all such modifications and changes that fall within the true spirit of the invention.

The invention claimed is:

1. A cable comprising:

a plurality of primary power conductors;

a plurality of secondary power conductors;

a metallic shield element surrounding the primary and secondary conductors;

a jacket surrounding the elements of the cable; and a plurality of heating element disposed under said shield element, wherein said plurality of heating elements are each disposed in interstices between said primary and secondary power conductors and said shield element, such that each heating element directly abuts, at least one primary conductor, at least one secondary conductor and said metallic shield.

2. The cable as claimed in claim 1, wherein said cable has an aramid fiber reinforcement layer disposed over said shield element.

3. The cable as claimed in claim 1, wherein said cable has an inner insulated jacket disposed over said aramid fiber reinforcement layer.

4. The cable as claimed in claim 1, wherein said cable has a braided armor disposed over said inner insulated jacket disposed.

5. The cable as claimed in claim 1, wherein said jacket surrounding the elements of the cable is an outer jacket disposed over said armor.

6. The cable as claimed in claim 1, wherein said cable has three primary power conductors.

7. The cable as claimed in claim 6, wherein said cable has three secondary power conductors.

* * * * *